US005215443A

United States Patent [19]

Hani et al.

[11] Patent Number: 5,215,443

[45] Date of Patent: Jun. 1, 1993

[54] HIGH PRESSURE LIQUID PUMP

[75] Inventors: Franz Hani, Geretsried; Hermann Breitsamer, Wolfratshausen, both of Fed. Rep. of Germany

[73] Assignee: Speck-Kolbenpumpenfabrik Otto Speck GmbH & Co. KG, Geretsried, Fed. Rep. of Germany

[21] Appl. No.: 767,160

[22] Filed: Sep. 27, 1991

[30] Foreign Application Priority Data

Sep. 28, 1990 [DE] Fed. Rep. of Germany ... 9013630[U]

[51] Int. Cl.[5] ..... F04B 21/04

[52] U.S. Cl. ..... 417/269; 417/529

[58] Field of Search ..... 417/269, 529

[56] References Cited

U.S. PATENT DOCUMENTS

| | | | |
|---|---|---|---|
| 3,002,528 | 10/1961 | Leissner | 417/269 |
| 3,018,737 | 1/1962 | Cook et al. | 417/269 X |
| 3,209,701 | 10/1965 | Phinney | 417/269 |
| 5,039,282 | 8/1991 | Terauchi | 417/270 |

FOREIGN PATENT DOCUMENTS

| | | | |
|---|---|---|---|
| 496065 | 4/1930 | Fed. Rep. of Germany | 417/269 |
| 1013521 | 8/1957 | Fed. Rep. of Germany | 417/269 |
| 535555 | 4/1941 | United Kingdom | 417/269 |

*Primary Examiner*—Leonard E. Smith
*Attorney, Agent, or Firm*—Townsend and Townsend

[57] ABSTRACT

A high pressure liquid pump has a drivable swash plate and a plunger which is acted on by the swash plate and guided in a cylinder bore of the pump housing. In the region of the front end of the plunger facing the swash plate a valve arrangement is provided between a low pressure chamber and a pump chamber. A second valve arrangement is arranged between the pump chamber and a high pressure chamber. The plunger has a transverse bore which stands in communication with the low pressure chamber during the pump movement and also has an axial bore extending from the transverse bore to the front end of the plunger, with the axial bore being enlarged towards the front end while forming a ring-like valve seat, with a valve insert being arranged in the broadened section of the axial bore.

23 Claims, 4 Drawing Sheets

HIGH PRESSURE LIQUID PUMP

BACKGROUND OF THE INVENTION

The invention relates to a high pressure liquid pump comprising a drivable swash plate, at least one plunger acted on by the swash plate and guided in a cylinder bore of the pump housing; a first valve arrangement provided in the plunger and arranged between a low pressure chamber and a pump chamber, and also a second valve arrangement arranged between the pump chamber and a high pressure chamber.

A high pressure liquid pump of this kind is known from EP-0 312 862.

SUMMARY OF THE INVENTION

The object underlying the invention lies in so developing a high pressure liquid pump of the same species that a high pump performance is achieved even during operation with high speeds of rotation with compact outer dimensions and low weight.

This object is satisfied in the pump of the invention in that the plunger has a transverse bore which communicates during the pump movement with the low pressure chamber and also an axial bore extending from the transverse bore to the front end of the plunger, in that the axial bore broadens towards the front end while forming a ring-like valve seat, and in that a valve insert is arranged in the broadened portion of the axial bore.

In this high pressure liquid pump the arrangement of the fluid channels which connect the low pressure chamber and the pump chamber and are formed within the plunger by the transverse bore and also by the axial bore is particularly space saving. The provision of the first valve arrangement within the plunger also permits a space saving assembly since the position of the first valve arrangement also makes it possible to keep the dead space portion of the pump chamber small so that a reliable suck-in characteristic is ensured at high driving speeds, i.e. at high pump frequencies.

The special layout of the valve insert permits a reliable guidance of the valve body with low flow resistance. The valve member is a ball which is axially freely movably received in the cage. This valve member operates without additional spring forces, with the opening and closing of the valve taking place through the movement of the plunger in conjunction with the inertia of the ball and the pressure difference between the pump chamber and the low pressure chamber. A special security is achieved in that the valve body is here directly compulsorily guided in the cage. The self-sucking characteristics of the pump at high speeds of rotation are enhanced by providing an additional reduction of the dead volume portion in the pump chamber.

The plunger is preferably made of light weight metal which ensures an additional weight reduction while the hardening of the plunger by coating ensures a reliable function of the plunger and subsequent machining of the plunger can be simultaneously omitted through the coating. It is furthermore advantageous to provide a hardened ball in the rear end of the plunger with the extremely hard surface of the ball standing in frictional contact with the swash plate and transmitting to the plunger the axial forces which act during operation of the swash plate on the ball.

The low pressure chamber is preferably constructed to permit a uniform inflow of fluid into the transverse bore of the plunger and moreover ensures a uniform cooling of the plunger. The provision of a ring space or part ring space serves to direct the heat which arises during operation of the pump out of the transmission space into the liquid to be pumped.

Another aspect of the present invention provides that a cylinder head insert representing a front boundary of the pump chamber can be manufactured of a harder material than the housing in order to withstand the high pressure generated in the pump chamber, so that in this way the housing can consist of less pressure-tight material, for example of a plastic or fibre reinforced plastic.

It is also advantageous that the high pressure outlet of the pump chamber lies in the especially manufactured cylinder head insert.

The design of the second valve arrangement and its placement between the cylinder head insert and the front housing cover is of advantage from a technical manufacturing viewpoint so that simple installation is possible.

Through the provision of the high pressure chamber in the front housing cover the latter can be manufactured separate from the remaining housing of more stable material.

The provision of a pressure relief valve between the high pressure chamber and the low pressure chamber serves for additional safety.

The eccentrically arranged drive shaft permits eccentric mounting of a drive and contributes in this manner to a more compact layout of the pump provided with a drive.

The provision of at least three plungers which are arranged mutually displaced relative to one another also ensures uniform pressure generation even at high speeds of rotation.

It is also advantageous that the drive motor with the drive shaft can be mounted or removed without dismantling the pump. The use of a squirrel cage (induction) electric motor permits manufacture at a favourable price with a high performance of the pump. It is in particular advantageous when the motor has a high speed of rotation 16,000–20,000 r.p.m. which is reduced to approximately 4000 r.p.m. by the toothed arrangement between the drive shaft and the swash plate.

BRIEF DESCRIPTION OF THE DRAWINGS

The invention will now be described in the following in more detail with respect to an embodiment and with reference to the drawings in which are shown.

DESCRIPTION OF THE PREFERRED EMBODIMENT

Figure 1:
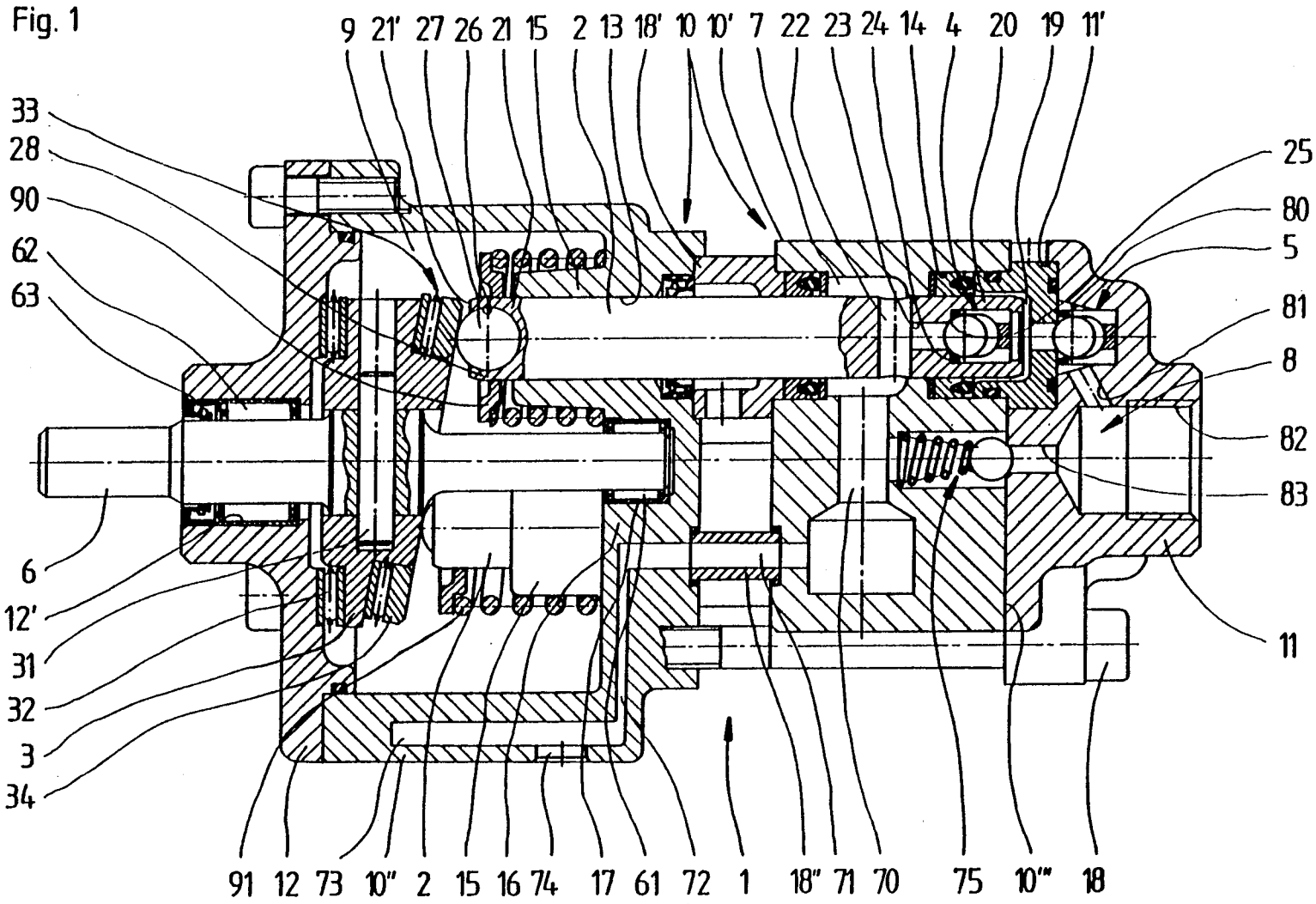
FIG. 1 a longitudinal section through a pump in accordance with the invention, FIG. 2 an enlarged representation of the pump of FIG. 1 in the region of a pump chamber, FIG. 3 an alternative embodiment with an eccentrically arranged drive, and FIG. 4 a further embodiment similar to the pump shown in FIG. 3.

In FIG. 1 there is shown a high pressure liquid pump with a pump housing 1 which consists of a housing body 10 with a front part 10' and a rear part 10''.

The rear part 10'' of the housing body 10 surrounds a transmission space 9 in which three receiving sleeves 15 are provided, in each case for a respective plunger 2.

The receiving sleeves 15 are formed in one piece with the housing base 16 of the first part 10'' of the housing body 10 and have a cylinder bore 13 for the plunger 2 which penetrates through the housing base 16. In the housing base 16 there is furthermore a bearing mount 17 for a first drive shaft bearing 61 of a drive shaft 6.

A part ring chamber 73 which partially surrounds the transmission space is provided in the peripheral wall of the rear part 10" of the housing body 10. This part ring chamber 73 has a low pressure fluid connection 74 which serves as a connection to a fluid supply line. A fluid connection consisting of the channels 70, 71 and 72 leads from the part ring space 73 to a low pressure chamber 7 which surrounds the plungers.

The rear part 10" of the housing body 10 is closed by a rear housing cover 12. The rear housing cover 12 has a throughbore 12' which serves for the passage of the drive shaft 6 and accommodates a second drive shaft bearing 62 and also a shaft seal ring 63.

A swash plate 3 is rotationally fixedly arranged on the drive shaft 6 within the transmission space 9, for example by means of a transverse pin 31. The swash plate 3 is braced via a ring-like axial bearing 32 against the inner side of the rear housing cover 12. At its inclined side facing away from the rear housing cover 12 the swash plate 3 is provided with an inclined axial bearing 33. The bearing ring 34 of the axial bearing 33 is freely movable relative to the swash plate 3 and stands in contact with ball 27 provided at the rear end 21 of each plunger 2. The swash plate 3 consists preferably of sintered material or of plastic in order to keep the weight low.

Figure 3:
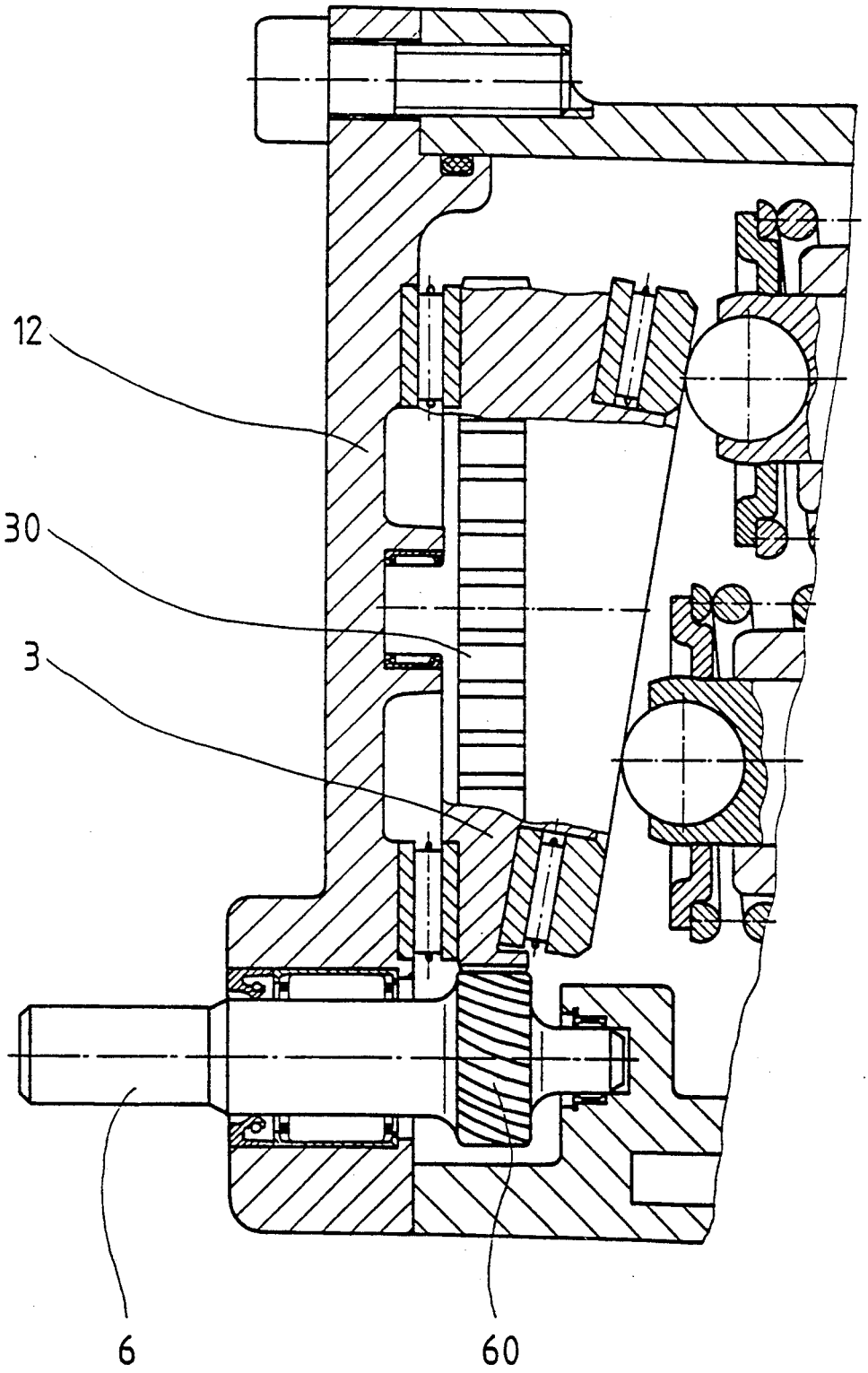

The drive of the swash plate 3 can also take place as an alternative in accordance with FIG. 3 in that the swash plate 3 which is axially and radially journalled in the housing cover 12 has a circumferential toothed arrangement 30 which stands directly or indirectly in engagement with a toothed gear 60 of the drive shaft 6 which is eccentrically guided through the rear housing cover 12.

The front part 10' of the housing body 10 is connected in known manner, for example by screws 18 with the rear part 10". Sealed cylinder sleeves 18' for the plungers 2 are provided between the front part 10' and the rear part 10". Furthermore a fluid duct 18" is provided between the two parts 10' and 10" of the housing body 10 for the fluid connection and has a section of the second channel 71.

An annular low pressure space 7 is formed in the front part of the housing 10, surrounds each plunger 2 and connects the cylinder bores 13 with one another. The first channel 70, which communicates via the second channel 71 and the third channel 72 with the ring space 73 and the low pressure fluid connection 74, opens into the low pressure space 7.

Each cylinder bore 13 continues coaxially in the front part 10' of the housing body 10 as the front section 13' of the cylinder bore 13. The end of the front section 13' of the cylinder bore 13 remote from the swash plate 3 is formed as a region 14 of enlarged diameter. In this region 14 of enlarged diameter a high pressure sealing ring 57 is inserted and the axially inner end face 50' of a cylinder head insert 50 inserted into the broadened bore region 14 of the front section 13' of the cylinder bore 13 contacts against the axially directed sealing lip 57' of the high pressure sealing ring 57. The section of the cylinder head insert 50 inserted into the bore region 14 has a circumferential groove 50" into which a low pressure seal 58 is inserted which acts radially against the inner wall of the region 14.

The cylinder head insert 50 has an axial "drive-in" recess 51 for the front end 20 of the plunger 2 the "dive-in" recess being open towards the cylinder bore 13. The "dive-in" recess is thereby dimensioned so that the front end 20 of the plunger 2 can project in the frontmost position of the plunger 2 beyond the front end face 10''' of the front part 10' of the housing body 10. The diameter of the axial "dive-in" recess 51 of the cylinder head insert 50 is thereby only fractionally larger than the outer diameter of the plunger. In this way the dead space formed between the plunger 2 and the cylinder head insert 50 in the frontmost position of the plunger 2 is very small.

A front housing cover 10 contacts against the front end face 10''' of the front part 10' of the housing body 10 and is provided with recesses 11' for the region of each cylinder head insert 50 which projects beyond the front end face 10'''.

The plunger 2 guided in the cylinder bore 13 has, at its rear end 21 which faces the swash plate 3, an axial cavity 26 into which a hardened ball 27, preferably a ball bearing ball is pressed to such a degree that a part of the ball surface projects beyond the rear edge 21' of the plunger 2. On pressing the ball 27 into the axial cavity 26 of the already hardened plunger 2 the periphery of the plunger 2 is broadened radially to the plunger axis in the region of the largest diameter of the ball. This broadened periphery 28 simultaneously serves to fixedly clamp a spring support ring 90 which annularly surrounds the plunger 2 to the plunger 2 in the region of the enlarged periphery 28.

In this arrangement the spring support ring thereby supports the one end of a coil spring 91 the other end of which contacts the housing base 16. The coil spring 91 is guided by the outer circumference of the receiving sleeve 15 for the plunger 2 which projects into the transmission space 9. In this manner the coil spring 91 ensures that the plunger 2 is pressed into its rearmost position, so that the ball 27 is in continuous contact with the free bearing ring 34 of the swash plate 3.

In the area of the front end 20 of the plunger 2 the plunger is provided with a transverse bore 22 which opens during the pump movement into the low pressure space 7. An axial bore 23 runs from the transverse bore 22 to the front end 20 of the plunger 2. The axial bore 23 broadens towards the front end 20 while forming a ring-like valve seat 25 into an enlarged section 24. A valve insert 40 is inserted into the broadened section 24 of the axial bore 23.

The valve insert 40 consists of a cage 41 and a valve member 42 which is movably guided therein and formed as a ball. First cage struts 44 are braced against the radial ring shoulder 29 formed at the transition from the axial bore 23 to the broadened section 24. The ball 42 is axially freely movably received in a guide track in the cage 41 and cooperates with the valve seat 25. The axial range of movement of the ball 42 is restricted at the side facing away from the valve seat 25 by a stroke restricting abutment 43. The stroke restricting abutment 43 is formed by a second cage strut 45 which engages behind radially inwardly directed latch projections 29' at the lower end 20 of the plunger 2 in the region of the mouth of the broadened section 24. The second cage strut 45 forming the stroke restricting abutment 43 can thereby be of relatively large volume in order—in just the same way as the ball 42—to fill out the space present within the broadened section 24 apart from the necessary fluid passage so that the remaining dead space is kept as small as possible.

The valve insert 40 can be formed as a pre-finished unit consisting of ball 42 and cage 41 which is inserted during installation of the pump into the enlarged section 24 of the axial bore 23 of the pump 2 and is then automatically latched therein.

The total plunger 2 is manufactured of light metal, in particular of an aluminium alloy, and is hardened at its outer surfaces and in the region of the axial bore 23 including the enlarged section 24 of the axial bore by a coating, preferably for example by the vapor deposition process. In this way the weight of the plunger is kept small without having to tolerate too much wear in the region of the severely stressed surfaces of the plunger.

A part ring space 80 is formed in the front housing cover 11, connects the receiving mounts 11' for the cylinder head inserts 50 to one another and opens into the axial throughbore 51 of each cylinder head insert. The part ring space 80 communicates via a high pressure channel 81 with the high pressure space 8 from which a high pressure fluid connection 82 emerges.

A pressure relief valve (or pressure control valve) 75 is provided between the high pressure space 8 and the low pressure space 7 and is disposed between the first channel 70 of the low pressure fluid communication and a junction channel 83 which opens into the high pressure space 8.

A second valve arrangement is inserted in the ring space 80 in the region of the opening of each axial throughbore 52. The second valve arrangement 5 consists of a premanufactured valve insert 54 which includes a valve cage 55 and also a valve member 56 which is axially guided in the latter. The valve member 56 is formed by a ball which cooperates with the valve seat formed by the front circumferential wall 53 of the axial throughbore 52. The second valve insert 54 is essentially formed in precisely the same way as the first valve insert 40 so that manufacturing costs can be saved by the use of like parts.

During the operation of the high pressure liquid pump the swash plate 3 is set into rotation via the drive shaft 6 and a commutator motor which operates with a high speed of rotation (up to 4500 r.p.m) is preferably used. The rotating swash plate acts with its inclined surface on the rear ends of the individual plungers so that the plungers are brought by the swash plate into their frontmost position and are pressed under the force of the respective coil spring back into their rearmost position again.

During the forward movement of the plunger (to the right in FIG. 1) the valve ball 42 of the first valve arrangement 4 is pressed as a result of its mass inertia and of the excess pressure which prevails in the pump chamber 19, against the valve seat 25 and thereby seals the pump chamber 19 relative to the low pressure chamber 7. During this movement of the plunger 2 a higher pressure is generated in the pump chamber 19 which ensures that the ball 56 of the second valve arrangement 5 lifts from the valve seat 53 and opens the communication between the pump chamber 19 and the high pressure chamber 8.

During the movement of the piston into its rearmost position (to the left in FIG. 1) the pump chamber 19 enlarges and the pressure there reduces. As a result of the thereby resulting pressure difference between the pump chamber 19 and the high pressure chamber 8 the ball 56 of the second valve arrangement 5 again contacts its valve seat 53 and thus seals the high pressure chamber 8 relative to the pump chamber 19. At the same time the ball 42 of the first valve arrangement 4 releases from the valve seat 25, as a result of its inertia and also the pressure difference between the pump chamber 19 and the space beneath the axial bore 23, and in this way the ball 42 frees the connection between the axial bore 23 and the pump chamber 19. As soon as the transverse bore 22 of the plunger 2 receives a connection to the low pressure chamber 7 fluid flows, as a result of the low pressure which arises there due to the volume increase of the pump chamber 19, out of the low pressure chamber 19 through the transverse bore 22, through the axial bore 23 and through the first valve arrangement 4 into the pump chamber 19 and the compression procedure can start again anew. The flowing away of fluid out of the low pressure chamber 7 brings about a subsequent flow of fluid through the fluid connection 74, through the part ring chamber 73 and the fluid connection 72, 71, 70 into the low pressure chamber 7, with heat from the part ring chamber 73 being simultaneously transported away.

As a result of the low pressure seal 58 provided in the cylinder head insert, which is fashioned in the same way as the high pressure seal 57, no leakage arises between the broadened section 24 and the cylinder head insert 50. Leakage flows emerging from the pump chamber are guided back along the outer periphery of the front section 20 of the plunger 2 directly into the low pressure chamber 7.

The arrangement of the suction channels (transverse bore 22 and axial bore 23) in the plunger 2 and also the position of the first valve arrangement in the front end 20 of the plunger enable a minimising of the dead space in the pump chamber 19, so that the high pressure liquid pump can be reliably operated with the desired high speeds of rotation and so that in particular no problems exist during the suction process.

Furthermore the extension of the high pressure region into the front housing cover 12 and also into the broadened section 24 of the axial bore 23 of the plunger 2 and into the axial "dive-in" recess 51 and the axial throughbore 51 of the cylinder head insert 50 permits a weight saving manufacture of the housing body 10, since the latter can be manufactured from a light plastic and only the front housing 11 and the cylinder head insert 50 can be formed of more resistant material, for example fibre reinforced plastic or light metal.

Figure 2:
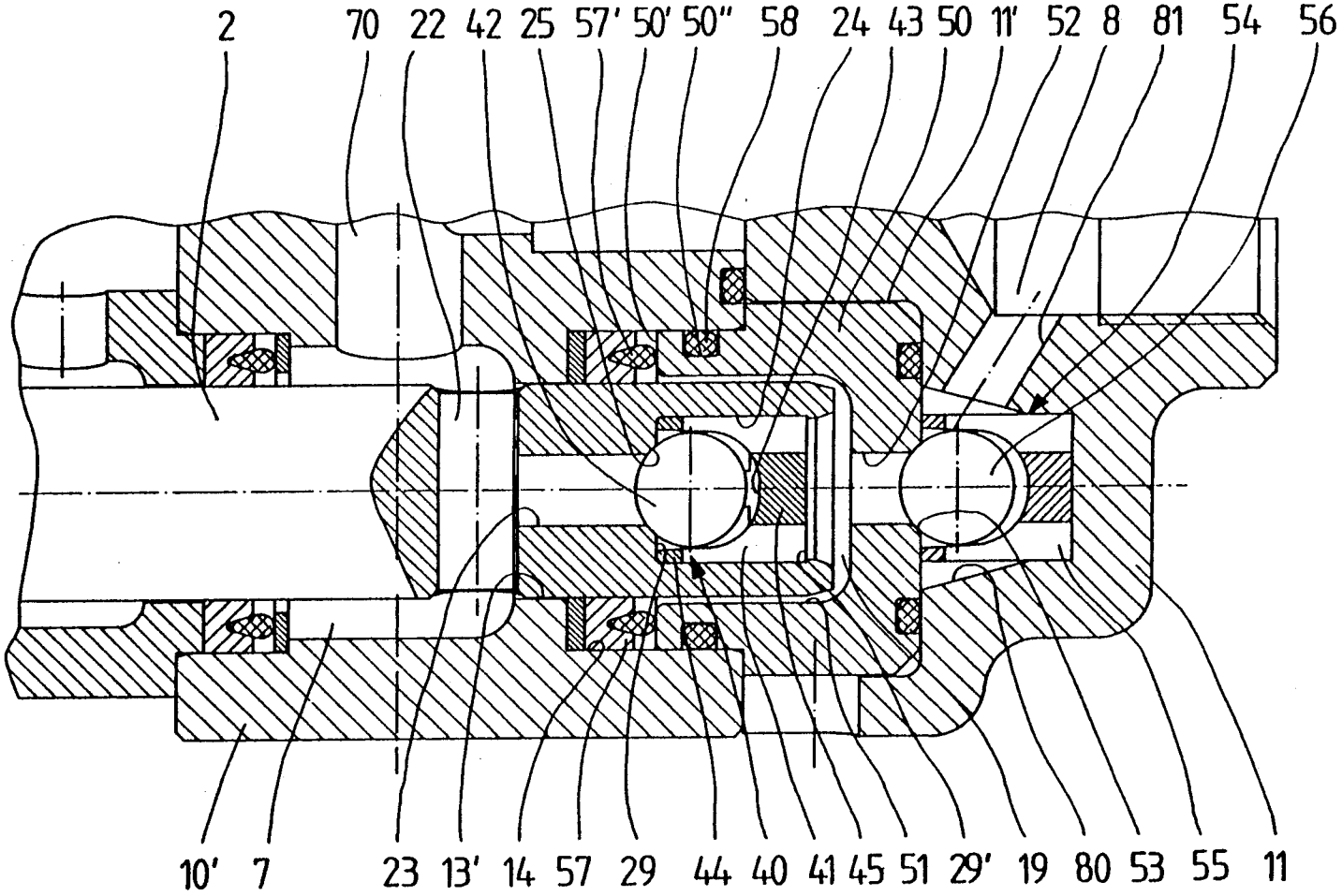
Figure 4:
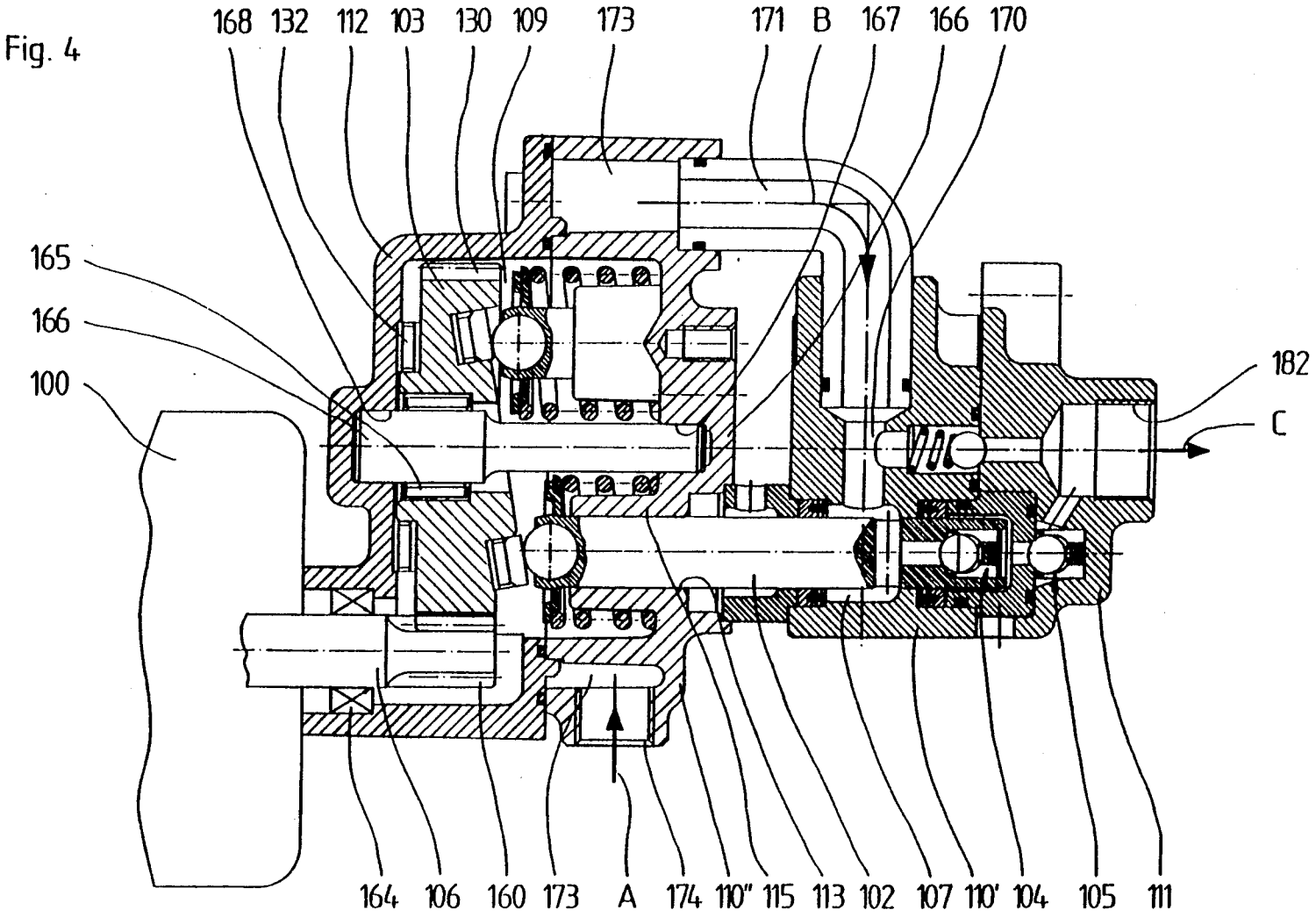

A further embodiment of the invention is shown in FIG. 4 and the reference numerals used in FIGS. 1 to 3 have been increased by 100.

In this embodiment the drive shaft 106 eccentrically penetrates the housing cover 112 as has already been described in the embodiment of FIG. 3. The outer diameter of the toothed gear 160 on the drive shaft 106 is in this arrangement essentially precisely as large as or smaller than the section of the drive shaft 106 accommodated by the drive shaft bearing 164 arranged in the housing cover 112, so that the drive shaft 106 of the squirrel cage electric motor 100 can be inserted into or removed from the pump which is already assembled without having to dismantle the pump.

In the arrangement of FIG. 4 the swash plate 103 is preferably rotatably journalled on a fixed axle 166 by means of a central radial bearing 165 with the axle 166 being held in a bore 167 in the rear housing part 110'' and also in a bore 168 in the rear housing cover 112. The liquid to be pumped is supplied to the pump by the low pressure fluid connection 174 (arrow A) and then flows in the ring or part ring chamber 173 of the rear housing part 110" around the transmission space 109 whereby the latter is cooled by the liquid. The liquid flows out of the ring or part ring chamber 173 through the channels 171 and 170 into the low pressure space 107 (arrow B) which surrounds the plungers 102. From there the liquid is pumped by means of the plunger 102 through the valve arrangements 104 and 105 while increasing its pressure, whereafter it leaves the pump again through the high pressure fluid connection 182 (arrow C).

We claim:

1. A high pressure liquid pump comprising;

a drivable swash plate;

at least one plunger acted on by the swash plate and guided in a cylinder bore of the pump housing;

a first valve arrangement provided in the plunger and arranged between a low pressure chamber and a pump chamber;

a second valve arrangement arranged between the pump chamber and a high pressure chamber, with the plunger having a transverse bore which communicates with the low pressure chamber during the pump movement and also an axial bore which extends from the transverse bore to the front end of the plunger, with the axial bore broadening towards the front end while forming a ring-like valve seat;

a valve arranged in the broadened section of the axial bore including a valve insert (40) in the region of a front end of the plunger remote from the swash plate and comprising a valve insert (40) having a cage (41) and a valve member (42) movably guided therein, the valve member (42) being a ball which is freely axially movably received in the cage (41) and the cage (41) having a guide track for the valve member (42), the cage (41) including in its region remote from the valve seat (25) a stroke restricting abutment (43) for the valve member (42); and a front end of a front section (13') of the cylinder bore (13) remote from the swash plate (3) having a region (14) with an enlarged diameter for insertion of a cylinder head insert (50) which includes an axial "dive-in" recess (51) for a front end (20) of the plunger (2), the diameter of the recess being only fractionally larger than the outer diameter of the plunger, the cylinder head insert (50) being equipped with an axial throughbore (52) cooperating with the second valve arrangement (5), having a circumferential rim (53) facing away from the "dive-in" recess (51), and forming a valve seat for the second valve arrangement (5) which furthermore includes a valve insert (54) received in a front housing cover (11), the valve insert (54) in the front housing cover and the valve insert (40) in the plunger (2) being formed as identical parts.

2. A high pressure liquid pump comprising;

a drivable swash plate;

at least one plunger acted on by the swash plate and guided in a cylinder bore of the pump housing;

a first valve arrangement provided in the plunger and arranged between a low pressure chamber and a pump chamber;

a second valve arrangement arranged between the pump chamber and a high pressure chamber, with the plunger having a transverse bore which communicates with the low pressure chamber during the pump movement and also an axial bore which extends from the transverse bore to the front end of the plunger, with the axial bore broadening towards the front end while forming a ring-like valve seat; and a valve arranged in the broadened section of the axial bore including a valve insert (40) in the region of a front end of the plunger remote from the swash plate and comprising a valve insert (40) having a cage (41) and a valve member (42) movably guided therein, the valve member (42) being a ball which is freely axially movably received in the cage (41) and the cage (41) having a guide track for the valve member (42), the cage (41) including in its region remote from the valve seat (25) a stroke restricting abutment (43) for the valve member (42), the swash plate (3, 103) having a toothed arrangement (30, 130) at its circumference cooperating with a toothed gear (60, 160) of a drive shaft (6, 160) extending eccentrically with respect to the swash plate (3, 103) into a transmission space (9, 109).

3. A high pressure liquid pump in accordance with claim 2, characterized in that the swash plate (103) is rotatably journalled on an axle (166) secured in the housing (110") and in the housing cover (112).

4. A high pressure liquid pump in accordance with claim 2, characterized in that the toothed gear (60, 160) of the drive shaft (6, 106) which is inserted eccentrically into the transmission space (9, 109) has essentially the same or a smaller outer periphery than the section of the shaft (106) introduced into the housing.

5. A high pressure liquid pump comprising:

a drivable swash plate;

at least one plunger acted on by the swash plate and guided in a cylinder bore of the pump housing;

a first valve arrangement provided in the plunger and arranged between a low pressure chamber and a pump chamber;

a second valve arrangement arranged between the pump chamber and a high pressure chamber, with the plunger having a transverse bore which communicates with the low pressure chamber during the pump movement and also an axial bore which extends from the transverse bore to the front end of the plunger, with the axial bore broadening towards the front end while forming a ring-like valve seat;

a valve arranged in the broadened section of the axial bore including a valve insert (40) in the region of a front end of the plunger remote from the swash plate and comprising a valve insert (40) having a cage (41) and a valve member (42) movably guided therein, the valve member (42) being a ball which is freely axially movably received in the cage (41) and the cage (41) having a guide track for the valve member (42), the cage (41) including in its region remote from the valve seat (25) a stroke restriction abutment (43) for the valve member (42), the transmission space being surrounded, at least partially, by a ring chamber or part ring chamber (73) which is connected to a fluid supply; and a fluid connection (70, 71) between the ring chamber or part ring chamber (73) and the low pressure chamber (7).

6. High pressure liquid pump in accordance with claim 5, characterized in that the element forming the stroke restricting abutment (43) is formed as a large volume space filler.

7. High pressure liquid pump in accordance with claim 5, characterized in that the high pressure space (8) is provided in the front housing cover (11).

8. High pressure liquid pump in accordance with claim 5, characterized in that a pressure control valve (75) is arranged between the high pressure chamber (8) and the low pressure chamber (7).

9. High pressure liquid pump in accordance with claim 5, characterized in that at least three plungers (2) are provided which are arranged displaced at an angle of 120° relative to each other.

10. High pressure liquid pump in accordance with claim 1, characterized in that the cage (42) can be snapped into the broadened section (24) of the axial bore (23).

11. High pressure liquid pump in accordance with claim 10, characterized in that the first struts (44) of the cage (41) contact ring shoulder (29) formed by the broadening of the axial bore (23) and in that second struts of the cage (45) at the other end of the cage (41) engage behind latch projections (29') projecting radially inwardly at the front end (20) of the plunger (2).

12. High pressure liquid pump in accordance with claim 5, characterized in that a squirrel cage motor (100) is provided for the drive of the high pressure liquid pump.

13. High pressure liquid pump in accordance with claim 12, characterized in that the speed of drive rotation of the squirrel cage motor (100) lies in the range of approximately 16000 to 20000 r.p.m., with the speed of rotation of the swash plate (3, 103) amounting to approximately 4000 r.p.m.

14. High pressure liquid pump in accordance with claim 5, characterized in that the plunger (2) comprises light metal and is hardened by coating at least at its outer surfaces and in the region of the axial bore (23).

15. High pressure liquid pump in accordance with claim 14 characterized in that the plunger (2) has, at its rear end (21) facing the swash plate (3), an axial cavity (26) into which a hardened ball (27), preferably a bearing ball, is at least partially pressed.

16. High pressure liquid pump in accordance with claim 15, characterized in that the plunger (2) has, in the region of the cavity provided with the ball (27), an enlarged circumference (28) which clampingly engages into a spring support ring (90) which engages around the plunger (2).

17. High pressure liquid pump in accordance with claim 5, characterized in that the swash plate (3, 103) has a toothed arrangement (30, 130) at its circumference which cooperates with a toothed gear (60, 160) of a drive shaft (6, 106) introduced eccentrically into the transmission space (9, 109) with respect to the swash plate (3, 103).

18. High pressure liquid pump in accordance with claim 17, characterized in that the swash plate (103) is rotatably journalled on an axle (166) secured in the housing (110") and in the housing cover (112).

19. High pressure liquid pump in accordance with claim 17, characterized in that the toothed gear (60, 160) of the drive shaft (6, 106) which is inserted eccentrically into the transmission space (9, 109) has essentially the same or a smaller outer periphery than the section of the shaft (106) introduced into the housing.

20. High pressure liquid pump in accordance with claim 5, characterized in that the front end remote from the swash plate (3) of the front section (13') of the cylinder bore (13) has a region (14) with an enlarged diameter into which a cylinder head insert (50) is inserted.

21. High pressure liquid pump in accordance with claim 20, characterized in that the cylinder head insert (50) has an axial "dive-in" recess (51, for the front end (20) of the plunger (2), the diameter of the recess being only fractionally larger than the outer diameter of the plunger; and in that the cylinder head insert (50) is equipped with an axial throughbore (52) which cooperates with the second valve arrangement (5).

22. High pressure liquid pump in accordance with claim 21, characterized in that the circumferential rim (53) of the axial throughbore (52) facing away from the "dive-in" recess (51) forms a valve seat for the second valve arrangement (5) which furthermore includes a valve insert (54) received in a front housing cover (11).

23. High pressure liquid pump in accordance with claim 22, characterized in that the valve insert (54) in the front housing cover (11) and the valve insert (40) in the plunger (2) are formed as identical parts.

* * * * *